US012433436B2

(12) United States Patent
Brady

(10) Patent No.: US 12,433,436 B2
(45) Date of Patent: Oct. 7, 2025

(54) TABLE TOP WINE AND CHAMPAGNE CHILLER

(71) Applicant: James Robert Brady, Millburn, NJ (US)

(72) Inventor: James Robert Brady, Millburn, NJ (US)

( * ) Notice: Subject to any disclaimer, the term of this patent is extended or adjusted under 35 U.S.C. 154(b) by 0 days.

(21) Appl. No.: 18/594,859

(22) Filed: Mar. 4, 2024

(65) Prior Publication Data

US 2024/0215743 A1 Jul. 4, 2024

Related U.S. Application Data

(60) Provisional application No. 63/436,909, filed on Jan. 4, 2023.

(51) Int. Cl.
*A47F 10/06* (2006.01)
*A47G 23/02* (2006.01)

(52) U.S. Cl.
CPC .. *A47G 23/0241* (2013.01); *A47G 2023/0283* (2013.01)

(58) Field of Classification Search
CPC ..... A47G 23/0241; A47G 23/02; A47G 2023/0283; A47G 19/12; F25D 2331/803
USPC ..... 215/395, 376, 393; 220/737, 739, 220/592.16; 211/74; 248/133; 62/457.8
See application file for complete search history.

(56) References Cited

U.S. PATENT DOCUMENTS

| | | | | |
|---|---|---|---|---|
| 1,762,082 | A | 6/1930 | Shiraishi | |
| 2,052,940 | A * | 9/1936 | Pitcher | A47G 7/06 47/41.1 |
| 2,633,248 | A * | 3/1953 | Goldenberg | A45D 34/00 211/74 |
| 4,163,374 | A | 8/1979 | Moore et al. | |
| 4,485,930 | A * | 12/1984 | Savelkouls | A47B 73/006 211/74 |
| 4,870,837 | A | 10/1989 | Weins | |
| 4,882,914 | A | 11/1989 | Haines-Keeley et al. | |
| 5,974,826 | A | 11/1999 | Baldwin et al. | |
| 7,568,362 | B2 | 8/2009 | Oas | |
| 8,621,885 | B1 | 1/2014 | Niebolte | |
| 9,222,714 | B2 | 12/2015 | Zebuhr et al. | |
| 9,915,472 | B2 | 3/2018 | Sabo | |
| 11,737,593 | B2 | 8/2023 | Kuzminski | |
| 2007/0261431 | A1 | 11/2007 | Cohen et al. | |
| 2014/0166672 | A1* | 6/2014 | Stroucken | F25D 3/08 220/592.01 |
| 2015/0143806 | A1* | 5/2015 | Friesth | F03G 7/04 220/592.2 |
| 2015/0276296 | A1 | 10/2015 | Smith | |
| 2016/0054052 | A1 | 2/2016 | Wang | |
| 2016/0109176 | A1* | 4/2016 | Harms | F25D 31/007 62/457.5 |
| 2016/0131421 | A1 | 5/2016 | Bogaard | |

(Continued)

*Primary Examiner* — Don M Anderson
*Assistant Examiner* — Elizabeth J Volz
(74) *Attorney, Agent, or Firm* — Dunlap Bennett & Ludwig, PLLC

(57) ABSTRACT

A beverage chiller includes a body having a frustoconical shape. The beverage chiller includes a cavity formed within the body. The cavity has a cylindrical shape. The cavity is slanted at a first angle relative to a base of the body. The beverage chiller includes a window formed in a sidewall of the body. The window exposes an interior space of the cavity.

6 Claims, 3 Drawing Sheets

(56) References Cited

U.S. PATENT DOCUMENTS

| | | | |
|---|---|---|---|
| 2017/0038119 | A1 | 2/2017 | Greer |
| 2023/0280092 | A1 | 9/2023 | Matsubayashi |

* cited by examiner

TABLE TOP WINE AND CHAMPAGNE CHILLER

CROSS-REFERENCE TO RELATED APPLICATIONS

This application claims the benefit of priority of U.S. provisional application No. 63/436,909, filed Jan. 4, 2023, "Wine Chiller. Method to Keep a bottle of wine chilled at the table," the entire contents of which are herein incorporated by reference.

FIELD

The present disclosure relates to beverage coolers.

BACKGROUND

Historically, white wine is served chilled. When brought to a serving location, e.g., table, the wine is placed in a bucket of ice on the floor to keep it chilled while being consumed. The ice bucket is inconvenient and inefficient because is requires the constant production of ice and it consume floor space when placed on or around the table. Other devices may use a glass-like cylinder, which offers minimal chilling.

As can be seen, there is a need for a beverage chiller that addresses the above drawbacks.

SUMMARY

In one aspect of the present disclosure, a beverage chiller includes a body having a frustoconical shape. The beverage chiller includes a cavity formed within the body. The cavity has a cylindrical shape. The cavity is slanted at a first angle relative to a base of the body. The beverage chiller includes a window formed in a sidewall of the body. The window exposes an interior space of the cavity.

DETAILED DESCRIPTION OF THE DISCLOSURE

The following detailed description is of the best currently contemplated modes of carrying out exemplary embodiments of the disclosure. The description is not to be taken in a limiting sense but is made merely for the purpose of illustrating the general principles of the disclosure, since the scope of the disclosure is best defined by the appended claims.

As discussed above, current wine chillers are inconvenient and inefficient. Broadly, an embodiment of the present disclosure provides a beverage chiller that reduces space requirements and the need for ice. The beverage chiller includes a frustoconical shape body that holds and chills a beverage bottle, e.g., a wine or champagne bottle. The beverage chiller includes a window in the body that allows the beverage bottle, e.g., a wine or champagne bottle, to be viewed by a user. As such, the beverage chiller showcases the beverage bottle, e.g., a wine or champagne bottle, and keeps the beverage chilled after being pre-chilled. Additionally, because of the reduced size of the beverage chiller, the beverage chiller can be placed on a table without consuming a large amount of table space.

Figure 1:
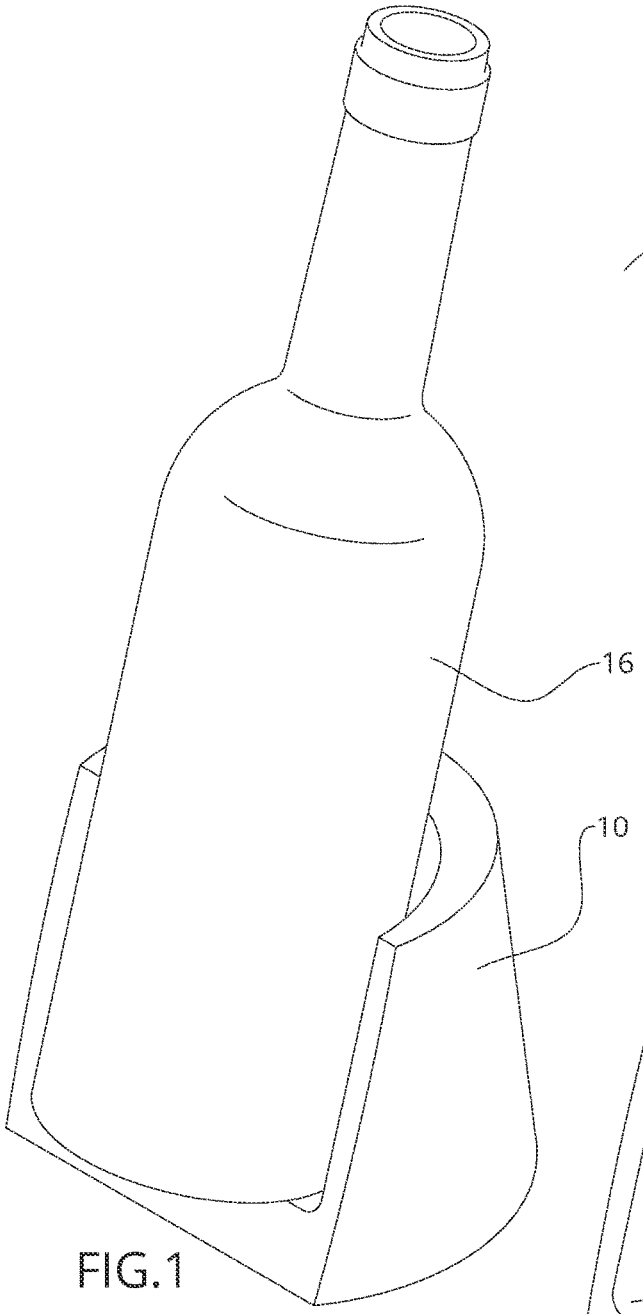
FIG. 1 is a perspective view of a wine chiller in use, according to aspects of the present disclosure.

Referring now to FIG. 1-5, FIG. 1 a illustrates a beverage chiller 1 (hereinafter the glacier 1), according to aspects of the present disclosure. While FIG. 1 illustrates examples of components of the glacier 1, additional components can be added, and existing components can be removed and/or modified.

Figure 2:
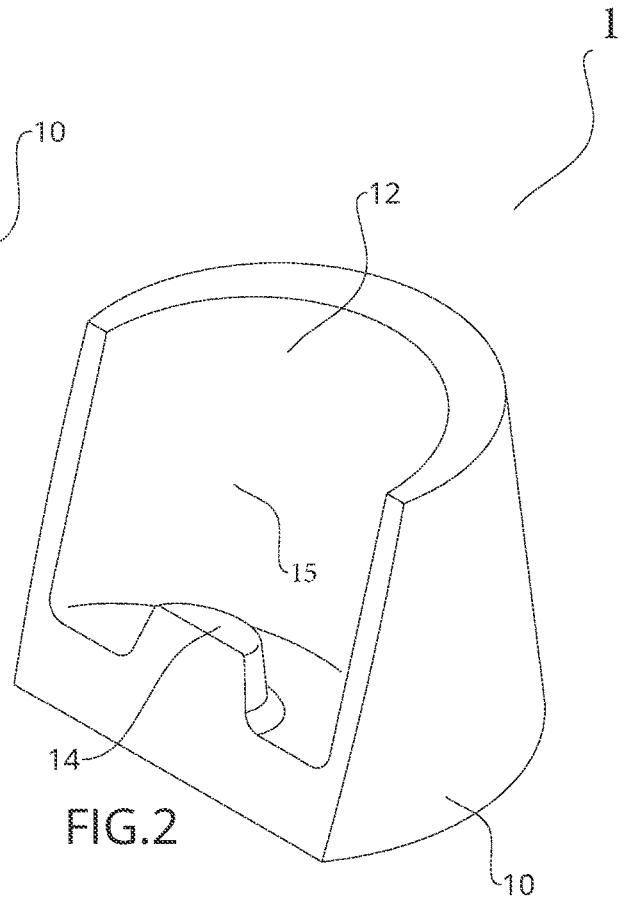
FIG. 2 is another perspective view of the wine chiller of FIG. 1, according to aspects of the present disclosure.
Figure 3:
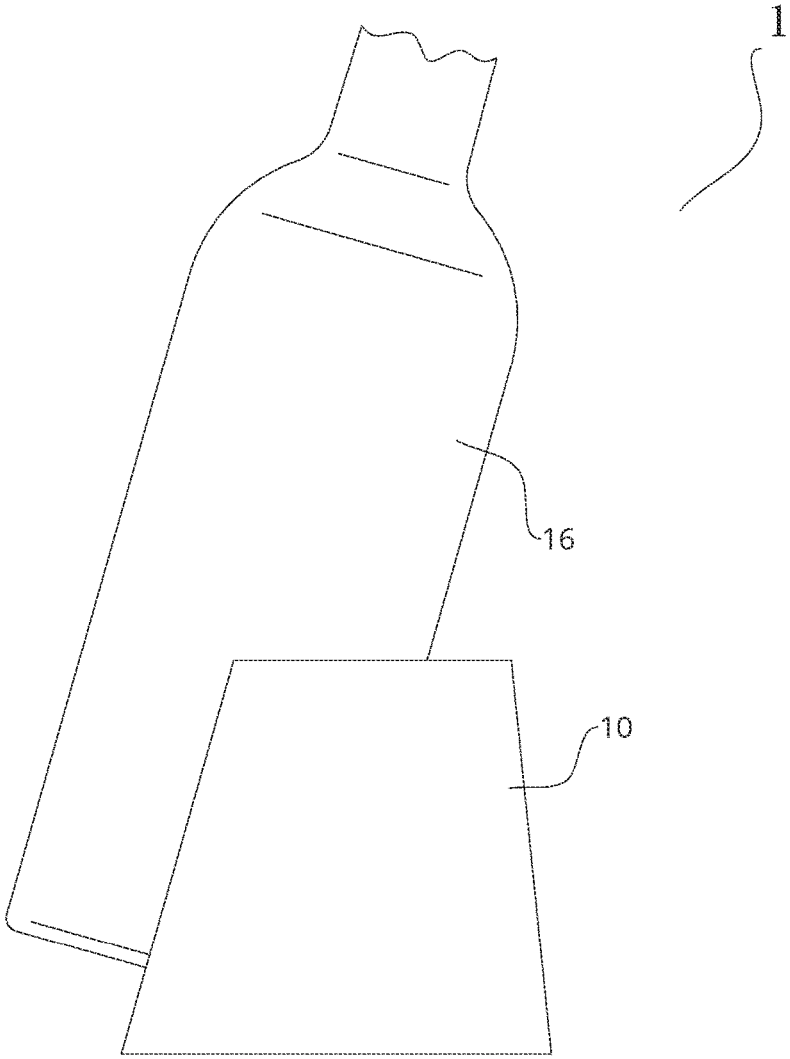
FIG. 3 is a side view of the wine chiller of FIG. 1, according to aspects of the present disclosure.
Figure 4:
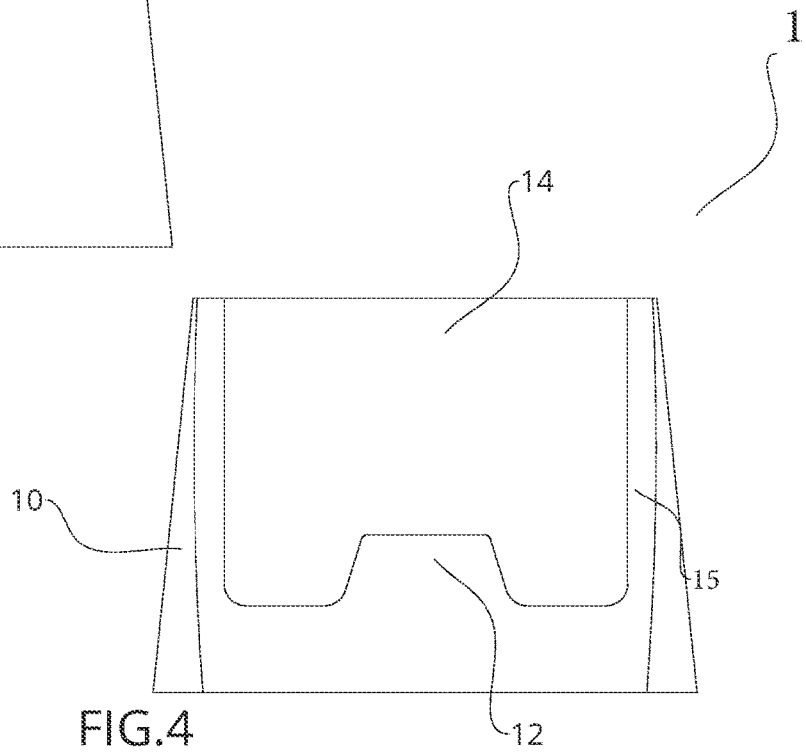
FIG. 4 is a front view of the wine chiller of FIG. 1, according to aspects of the present disclosure.

As illustrated in FIGS. 1 and 3, the glacier 1 includes a body 10 that is configured to hold a beverage bottle 16, e.g., a wine and/or champagne bottle. The body 10 can have a frustoconical shape in which the base of the body 10 has a larger cross-sectional area relative to the top of the body 10 which a smaller cross-sectional area. As illustrated in FIGS. 2 and 4, the body 10 of the glacier includes a cavity 14 for holding the beverage bottle 16. The cavity 14 is formed with a cylindrical shape that matches the shape of a beverage bottle 16. The body 10 includes a window 15 formed in a side of the body 10 that exposes a portion of the cavity 14. As such, when the beverage bottle 16 is placed in the cavity 14, a portion of the side of the beverage bottle 16 is exposed and visible through the window 15 outside of the glacier 1.

The body 10 includes a post 12 that extends upward from the bottom of the cavity 14. The post 12 is configured to fit within a cavity in the base of the beverage bottle 16. The post 12 operates to prevent the beverage bottle 16 from sliding out of the cavity 14. The post 12 can have a frustoconical shape in which the base of the body 10 has a larger cross-sectional area relative to the top of the body 10 which a smaller cross-sectional area.

As illustrated in FIGS. 1 and 3, the cavity 14 can be slanted at an angle relative to the base of the body 10. The slant of the cavity 14 causes the beverage bottle 16 to lean against a sidewall of the cavity 14 and prevents the beverage bottle from tipping out of the window 15. In one example, the angle of the cavity 14 relative to the base of the body 10 can be formed such that the center of gravity of the beverage bottle 16 is outside the base of the beverage bottle 16.

In embodiments, the glacier 10 can be formed of concrete. To form the glacier 10, a mold in the shape of the glacier can be constructed. Then, the concrete can be poured into the mold and allowed to dry to form the glacier 10. In embodiments, the concrete used to form the glacier 10 can be a combination of a concrete mix made by Reynolds Advanced Materials, a water reducer, and a plasticizer.

Figure 5:
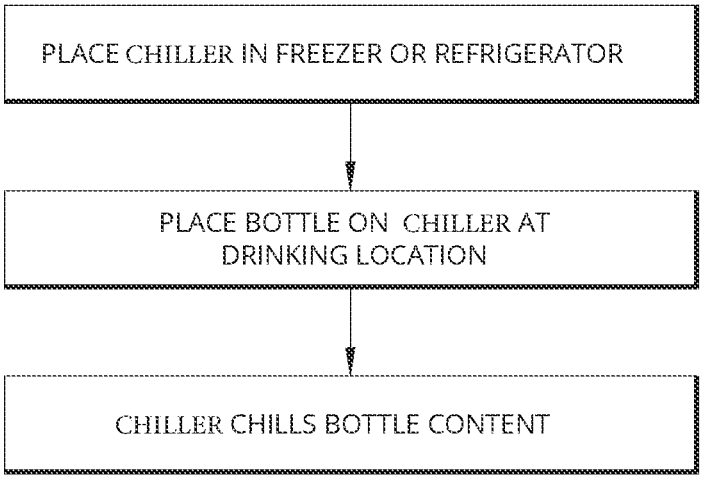
FIG. 5 is a flowchart of a process for using the wine chiller of FIG. 1, according to aspects of the present disclosure.

FIG. 5 illustrates a process for using the glacier 10, according to aspects of the present disclosure. As illustrated, the glacier 10 can be placed in a cold area, e.g., a freezer or refrigerator, to cool the glacier 10. Once cooled, the glacier 10 can be placed at a desired location, e.g., table, and a beverage bottle 16, e.g., a wine and/or champagne bottle, can be placed in the cavity 14 of the glacier 10. Once placed, the glacier can chill/cool the content of the beverage bottle 16, e.g., a wine and/or champagne bottle.

As used in the description herein and throughout the claims that follow, "a", "an", and "the" include plural references unless the context clearly dictates otherwise. Also, as used in the description herein and throughout the claims that follow, the meaning of "in" includes "in" and "on" unless the context clearly dictates otherwise. While the above is a complete description of specific examples of the disclosure, additional examples are also possible. Thus, the above description should not be taken as limiting the scope of the disclosure which is defined by the appended claims along with their full scope of equivalents.

The foregoing disclosure encompasses multiple distinct examples with independent utility. While these examples have been disclosed in a particular form, the specific examples disclosed and illustrated above are not to be considered in a limiting sense as numerous variations are possible. The subject matter disclosed herein includes novel and non-obvious combinations and sub-combinations of the various elements, features, functions and/or properties disclosed above both explicitly and inherently. Where the disclosure or subsequently filed claims recite "a" element, "a first" element, or any such equivalent term, the disclosure or claims is to be understood to incorporate one or more such elements, neither requiring nor excluding two or more of such elements. As used herein regarding a list, "and" forms a group inclusive of all the listed elements. For example, an example described as including A, B, C, and D is an example that includes A, includes B, includes C, and also includes D. As used herein regarding a list, "or" forms a list of elements, any of which may be included. For example, an example described as including A, B, C, or D is an example that includes any of the elements A, B, C, and D. Unless otherwise stated, an example including a list of alternatively-inclusive elements does not preclude other examples that include various combinations of some or all of the alternatively-inclusive elements. An example described using a list of alternatively-inclusive elements includes at least one element of the listed elements. However, an example described using a list of alternatively-inclusive elements does not preclude another example that includes all of the listed elements. And, an example described using a list of alternatively-inclusive elements does not preclude another example that includes a combination of some of the listed elements. As used herein regarding a list, "and/or" forms a list of elements inclusive alone or in any combination. For example, an example described as including A, B, C, and/or D is an example that may include: A alone; A and B; A, B and C; A, B, C, and D; and so forth. The bounds of an "and/or" list are defined by the complete set of combinations and permutations for the list.

It should be understood, of course, that the foregoing relates to exemplary embodiments of the disclosure and that modifications can be made without departing from the spirit and scope of the disclosure as set forth in the following claims.

What is claimed is:

1. A beverage chiller, comprising:

a solid body comprising a frustoconical shape, wherein the solid body is entirely formed of concrete;

a cavity formed within the solid body, wherein:

the cavity has a cylindrical shape and is configured to receive a bottle that directly contacts the solid body, and the cavity is slanted at a first angle relative to a base of the solid body; and a sidewall of the solid body having a curved portion defining the cavity and a flat front face defining a window formed in said sidewall, wherein the window exposes an interior space of the cavity, wherein the flat front face is slanted at the first angle relative to the base of the solid body so that a portion of the received bottle protrudes from the window.

2. The beverage chiller of claim 1, further comprising:

a post extending from a bottom of the cavity.

3. The beverage chiller of claim 2, wherein the post is positioned in a center of the cavity and has a frustoconical shape.

4. The beverage chiller of claim 3, wherein the flat front face comprises a continuous surface that extends across and interconnects the sidewall, the base and the post.

5. The beverage chiller of claim 1, wherein the concrete is formed from a mix comprising a concrete mix, a water reducer, and a plasticizer.

6. The beverage chiller of claim 1, wherein the cavity is formed having a cross-sectional area that matches a cross-sectional area of a wine bottle.

* * * * *